United States Patent [19]

Fujita et al.

[11] 4,121,046

[45] Oct. 17, 1978

[54] CORONA SHIELD FOR TENSION INSULATOR ASSEMBLY

[75] Inventors: Hiroshi Fujita, Inuyama; Kazuhisa Kato, Nagoya, both of Japan

[73] Assignee: NGK Insulators, Ltd., Nagoya, Japan

[21] Appl. No.: 831,285

[22] Filed: Sep. 7, 1977

[30] Foreign Application Priority Data

Sep. 13, 1976 [JP] Japan ..... 51-108829

[51] Int. Cl.[2] ..... H01B 17/44; H01B 17/48

[52] U.S. Cl. ..... 174/141 R; 174/140 CR

[58] Field of Search ..... 174/40 R, 43, 140 R, 174/140 H, 140 CR, 141 R, 144, 149 R, 150

[56] References Cited

U.S. PATENT DOCUMENTS 2,539,641 1/1951 Sheadel ..... 174/140 CR 2,597,590 5/1952 McCoy ..... 174/140 CR X

*Primary Examiner*—Laramie E. Askin

*Attorney, Agent, or Firm*—Stevens, Davis, Miller & Mosher

[57] ABSTRACT

A corona shield for tension insulator assemblies for use in extra-high and ultra-high voltage overhead transmission lines comprises shielding rings at anchored ends of conductors consisting of a plurality of rings arranged in planes substantially along the longitudinal direction of the conductors so as to surround them and further at least one ring horn arranged perpendicular to the conductors at energized ends of the insulator strings anchoring the conductors, thereby preventing corona discharge from the insulators and line hardware on the energized side of insulator assemblies.

6 Claims, 3 Drawing Figures

CORONA SHIELD FOR TENSION INSULATOR ASSEMBLY

BACKGROUND OF THE INVENTION (1) Field of the Invention

The present invention relates to a corona shield for tension insulator assemblies, and more particularly to a shield for preventing corona discharge occurring on the energized side of tension insulator assemblies mainly for extra-high and ultra-high voltage overhead transmission lines.

(2) Description of the Prior Art:

Recently, as the capacity of the electric power transmission has generally been greatly increased, the insulator assemblies for extra-high and ultra-high voltage overhead transmission lines have become large in size. In general, these insulator assemblies have attached ring horns integral therewith or separate therefrom for preventing corona discharge or protecting the insulators from arc. The shields for such large-sized insulator assemblies require correspondingly large-sized ring horns having large pipe diameters and outer diameters.

The hitherto used shielding with ring horns, however, has a disadvantage in that the corona characteristic of the shielding ring itself becomes degraded due to corona discharge from water droplets on the shielding ring under wet conditions, although a sufficient shielding effect can be expected under dry conditions.

To overcome this disadvantage, it has been suggested that metal tubes having small diameters be turned into the form of a cage to provide a shielding ring having a large outer diameter. However, a shielding ring of this type is not practical because it is difficult to install and expensive to manufacture and is likely to be covered with snow.

SUMMARY OF THE INVENTION

It is an object of this invention to overcome the above described difficulties heretofore encountered in corona shielding for tension insulator assemblies.

It is another object of the invention to provide an improved corona shield for tension insulator assemblies which is small and simple in construction, easy to install and inexpensive to manufacture.

It is a further object of the present invention to provide a novel corona shield for extra-high and ultra-high voltage tension insulator assemblies by preventing corona discharge from the insulators and line hardware on the energized side.

The corona shield for tension insulator assemblies according to the invention comprises shielding rings provided at the anchored end of the conductors and consisting of a series of plural rings arranged in planes substantially along the longitudinal direction of said conductors to surround them.

In another aspect, the corona shield for tension insulator assemblies further comprises at least one ring horn arranged perpendicular to the conductors at the energized ends of the insulator strings anchoring said conductors.

BRIEF DESCRIPTION OF THE DRAWING

These and other objects and advantages of the invention may be readily ascertained by referring to the following description and appended drawings in which.

DESCRIPTION OF THE PREFERRED EMBODIMENTS

Figure 1:
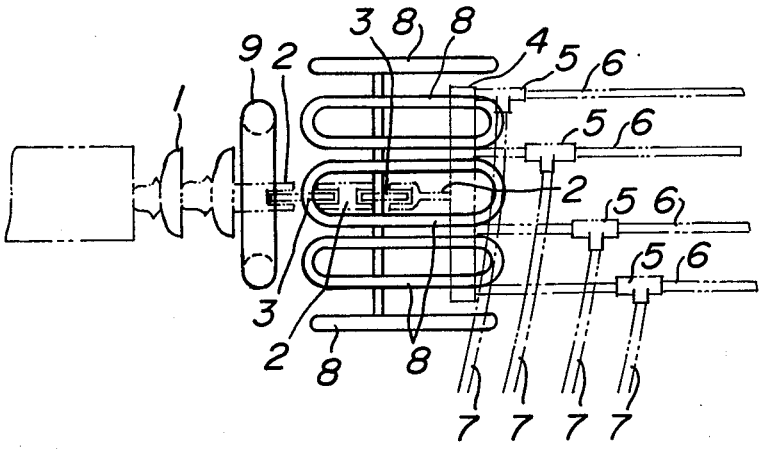
FIG. 1 is a side elevation of one embodiment of the corona shield according to the invention showing its assembled construction.
Figure 2:
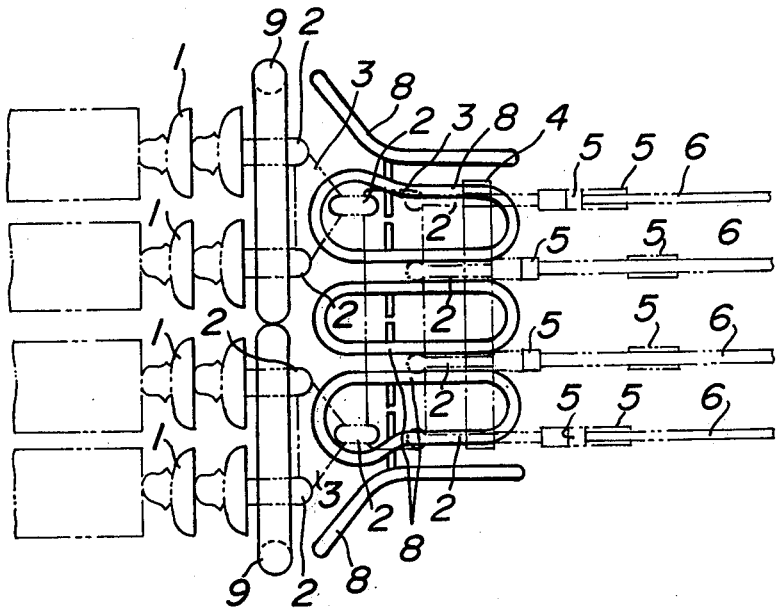
FIG. 2 is a plan view of the corona shield shown in FIG. 1.
Figure 3:
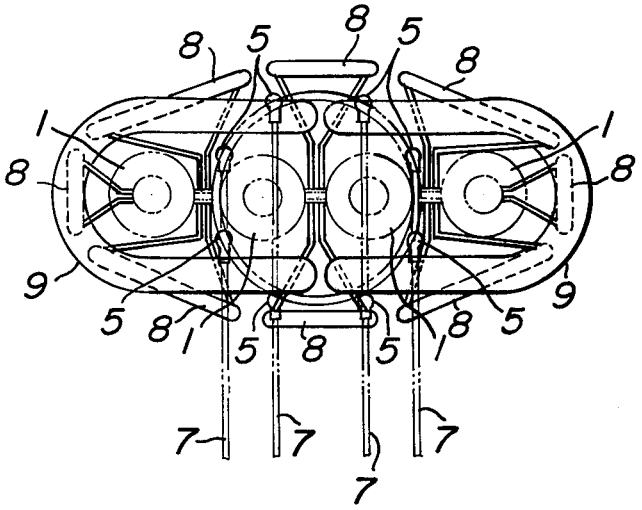
FIG. 3 is a front elevation of the corona shield shown in FIG. 1.

Referring to the embodiment of the invention shown in FIGS. 1–3, a plurality of insulator strings 1 gathered together by connecting fittings or line hardware 2 and yokes 3, and a plurality of conductors 6 anchored by compression clamps 5 are connected by conductor anchoring yokes 4. With the insulator assembly having jumper wires 7 extending downwardly from the compression clamps 5, to ends of the insulator strings 1 on the energized side are attached ring horns 9 having suitable pipe diameters and outer diameters and arranged perpendicular to the conductors 6. To ends of the plurality of conductors 6 on the energized side are attached a plurality of shielding rings 8 having suitable pipe diameters and outer diameters extending in planes along the longitudinal direction of the conductors and surrounding the conductors and the line hardware or connecting fittings connecting the insulator strings and the ends of the conductors. The plurality of shielding rings 8 serve to prevent corona discharge from the line hardware on the energized side. The ring horns 9 are preferably provided for preventing corona discharge from the insulators on the energized side.

Though eight shielding rings 8 are provided, as shown in the embodiment in FIGS. 1–3, the number of the shielding rings may be increased or decreased as the case may be. The shield rings attached to the underside of the ends of the conductors may be removed because of the shielding effect of the jumper wires 7 extending downwardly. The extensions of the plurality of the shield rings 8 towards the insulator strings need not cover the ring horns 9 attached to the energized ends of the insulator strings. The extensions of the shielding rings may extend to form a suitable interval with the ring horns 9. The shielding rings 8 themselves may also be in the planes substantially along the longitudinal direction of the conductors 6. The ends of the plurality of shielding rings 8 on the side of the conductors are preferably arranged adjacent to the conductors 6 as close as possible in order to prevent corona discharge from the shielding rings themselves. However, the ends of the shield rings 8 need not be in contact with the conductors 6.

With a tension insulator assembly consisting of four insulator strings, which is the illustrated embodiment of the invention, sides of ring horns 9 extend beyond the outer diameter of the plurality of electric conductors, so that corona discharge from the ring horns themselves may occur. In order to prevent this discharge, the ends of the plurality of shielding rings 8 on the side of the insulator strings may extend radially outwardly to the radial extension of the ring horns 9 obliquely to the direction of the electric conductors.

The corona shield for tension insulator assemblies according to the invention is small and simple in construction, easy to install, and inexpensive to manufacture because of the light weight rings and ring horns, and is further effective as a corona shield for extra-high and ultra-high voltage tension insulator assemblies owing to the prevention of corona discharge from the insulator strings and line hardware on the energized side, so that the corona shield according to the invention will greatly contribute to the progress of the industries.

While the described embodiment represents the preferred form of the present invention, it is considered that modifications will be made by those skilled in the art without departing from the spirit of the invention. The scope of the invention is therefore to be determined solely by the appended claims.

What is claimed is:

1. An apparatus for corona shielding a high tension insulator assembly having a plurality of insulator strings anchoring a plurality of conductors with line hardware comprising at least three shielding rings substantially surrounding the line hardware at the anchored ends of said conductors but not said insulator strings, each ring having a substantial portion thereof forming a respective plane extending substantially along the longitudinal direction of said conductors.

2. A corona shielding apparatus as set forth in claim 1, which further comprises at least one ring horn arranged perpendicularly to the conductors and disposed at the energized ends of the insulator strings anchoring said conductors.

3. A corona shielding apparatus as set forth in claim 2, wherein the shielding rings provided at the anchored ends of the conductors extend to form an interval with said ring horn provided at the energized ends of said insulator strings.

4. A corona shielding apparatus as set forth in claim 1, wherein said shielding rings are disposed to substantially surround the anchored ends of said conductors except where said conductors have jumper wires extending downwardly therefrom.

5. A corona shielding apparatus as set forth in claim 1, wherein the shielding rings provided at the anchored ends of the conductors extend at their ends adjacent to said conductors as close as possible.

6. An apparatus for corona shielding a high tension insulator assembly having a plurality of insulator strings anchoring a plurality of conductors comprising at least three substantially oblong rings surrounding the termination of said conductors at said insulator strings, said shielding rings being substantially arranged in respective planes along the longitudinal direction of said conductors, a ring horn disposed perpendicularly to said respective planes and said conductors, said ring horn being provided at the energized ends of said insulator strings and having a portion thereof extending beyond said planes surrounding said conductors, the end of at least one of said elongated rings flaring radially outwardly of a respective plane to maintain a substantially uniform spacing between said shielding rings and ring horn.

* * * * *